United States Patent [19]

Baranowski et al.

[11] 4,214,385

[45] Jul. 29, 1980

[54] APPARATUS FOR TAKING UP AND REMOVING MATTER FROM A SURFACE

[76] Inventors: Boleslaw Baranowski; William Baranowski, both of 306 Harrison Gardens, Harrison, N.J. 07029

[21] Appl. No.: 951,754

[22] Filed: Oct. 16, 1978

[51] Int. Cl.[2] ..... E01H 5/02

[52] U.S. Cl. ..... 37/130; 294/55

[58] Field of Search ..... 37/130, 53; 294/53.5, 294/54, 55

[56] References Cited

U.S. PATENT DOCUMENTS 2,863,232 12/1958 Steinbach et al. ..... 37/130 X 3,337,973 8/1967 Prescott ..... 37/130 X

*Primary Examiner*—E. H. Eickholt

*Attorney, Agent, or Firm*—Carella, Bain, Gilfillan & Rhodes

[57] ABSTRACT

An apparatus for taking up and removing matter from a surface upon movement of said apparatus along said surface. The apparatus is similar to a snow shovel and has a scoop portion and a handle portion secured thereto and is provided with one or more wheels rotatably mounted on an axle secured to the apparatus. The axle and wheels are secured to the apparatus so as to maintain the scoop portion of the apparatus at a predetermined angle relative to the surface.

2 Claims, 3 Drawing Figures

APPARATUS FOR TAKING UP AND REMOVING MATTER FROM A SURFACE

BACKGROUND OF THE INVENTION

1. Field of the Invention

The invention relates generally to apparatus for taking up and removing matter from a surface upon the movement of the apparatus along said surface. In particular, the invention relates to snow shovels.

2. Description of the Prior Art

Apparatus for taking up and removing matter from a surface upon the movement of said apparatus along the surface are well known in the prior art. For example, snow shovels constitute such prior art apparatus. Such prior art apparatus are designed to be used manually by a user.

Prior art snow shovels, for example, must be moved by a user along a surface in order to take up and remove snow from the surface. The leading edge of a prior art snow shovel must be urged against and under the matter to be moved. Such prior art snow shovels must be maintained within a range of predetermined angles relative to the surface in order to facilitate use and to be efficient in moving the snow. Additionally, such a prior art snow shovel requires considerable effort by a user in order to move it horizontally and also maintain the shovel at desired angles. This is especially difficult for elderly users. Furthermore, as a prior art snow shovel is moved further into the snow an increasing quantity of snow is necessarily deposited on the scoop portion of the snow shovel thereby making it increasingly difficult to maintain the snow shovel at the proper angle. In the past, this situation has been temporarily rectified by lifting up the shovel and casting the snow deposited thereon to the side.

It is also known in the prior art to combine a snowplow with some means of moving it. However, such prior art snowplows are generally powered by motorized or mechanical means. Accordingly, such prior art devices are complex and costly and therefore unavailable for use by many users.

Prior art manual snow shovels do not have the advantages inherent in motorized snowplows, the scoop of the latter being maintained at a predetermined angle and being moved mechanically forward. The prior art manual snow shovels are difficult to use even if the scoop portions thereof are shaped similarly to familiar snowplow scoops which are curved to guide snow to one side. A manual shovel with such a scoop shape is difficult to use as are other shapes, because a user must exert considerable vertical force on the handle to maintain the shovel at the proper angle and must exert considerable horizontal force to push or move the snow shovel through the snow. The horizontal force required continually increases due to (1) the increasing friction between the surface being shoveled and the leading edge of the snow shovel due to the weight of the snow gathered or forced into the scoop of the snow shovel, and (2) the increasing weight of the snow gathered or forced into the scoop of the snow shovel. The increasing weight of snow also requires a user to exert greater vertical force to maintain the desired angle.

Accordingly, there exists a need for a simple and inexpensive manually operable apparatus for taking up and removing matter such as snow from a surface.

SUMMARY OF THE INVENTION

An apparatus for taking up and removing matter such as snow from a surface upon the movement of said apparatus along said surface. The apparatus includes a scoop portion and a handle portion secured thereto, the scoop portion having a front surface and a back surface, the front surface and the back surface being in contiguity along a leading edge. The apparatus is maintained at a predetermined angle with respect to the surface and in the embodiment disclosed by an axle secured to the apparatus at a predetermined point therealong and the diameter of a wheel, or wheels, mounted rotatably on the axle maintain the apparatus at a predetermined angle with respect to the surface as the apparatus rolls along the surface. The scoop portion may be skewed with respect to the direction of movement of the apparatus such as by use of one rod pivotally secured to each end of the axle. The other ends of these rods are pivotally secured to a cross-member, the center of which is pivotable about a point on the handle such that, upon pivoting of the cross-member, each rod is moved and causes the axle to be skewed relative to the scoop portion.

An object of the present invention is to provide a simple and inexpensive manually operable apparatus for taking up and removing matter such as snow from a surface upon movement of the apparatus along the surface.

A further object of this invention is to provide a manually operable and skewable apparatus for taking up and removing matter from a surface.

DESCRIPTION OF THE PREFERRED EMBODIMENT

An understanding of the invention may best be obtained by reference to the drawings.

Figure 1:
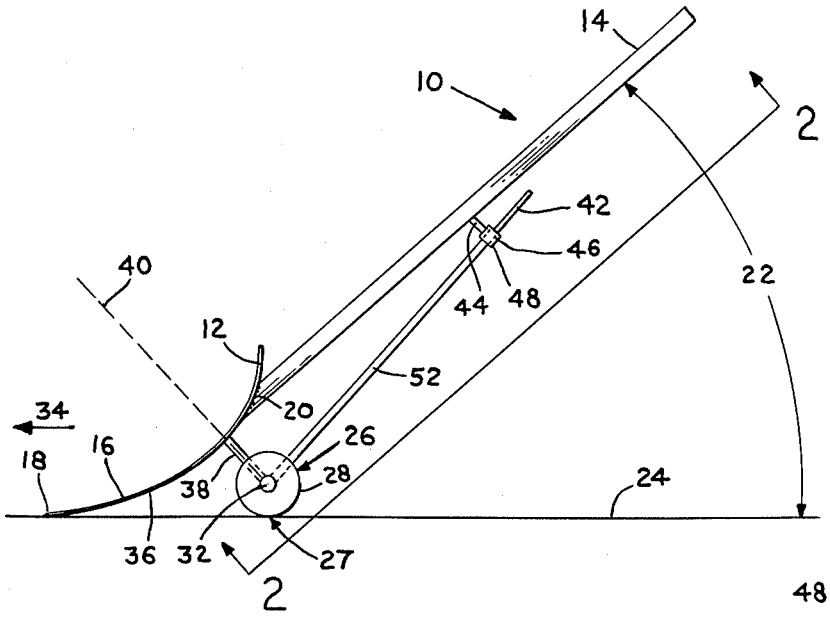
FIG. 1 is a side elevational view of a preferred embodiment of apparatus for taking up and removing matter from a surface and embodying the present invention.

Accordingly, referring now to FIG. 1, there is shown a side elevation of an improved apparatus for taking up and removing matter from a surface, generally designated by 10. Apparatus 10 comprises a scoop portion 12 and an elongated handle portion 14. Scoop portion 12 has a generally curved front surface 16 and a back surface 36 which meet and are contiguous along a leading edge 18. Handle portion 14 is secured to scoop portion 12 at 20 by riveting or any other suitable method well known to those skilled in the art. It will further be understood by those skilled in the art that scoop portion 12 may generally be constructed of a rigid, non-deformable metal such as steel, aluminum, etc. Additionally, it will be understood by those skilled in the art that handle portion 14 may be a solid or tubular structure, and may be constructed of suitable rigid material of varying lengths.

Figure 2:
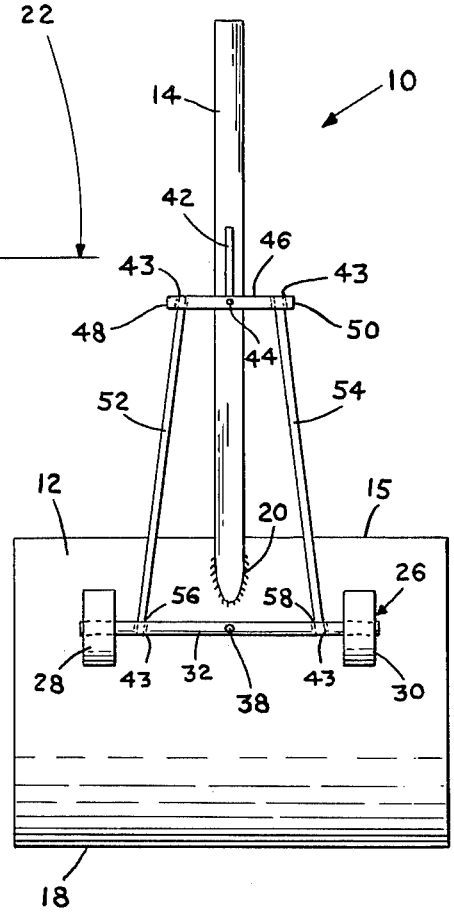
FIG. 2 is a plan view of FIG. 1 taken along line 2—2.

Referring now to FIGS. 1 and 2, wheel means 26, as utilized in the preferred embodiment, comprises two symmetrical wheels 28 and 30 rotatably mounted on an axle 32 and interposed between apparatus 10 and surface 24. Wheel means 26 may be a single wheel having a predetermined diameter or a plurality of wheels each having similar diameters. As will be understood by those skilled in the art, the particular wheel diameter chosen and the point of attachment of axle 32 to apparatus 10 will determine the angle of inclination 22 at which apparatus 10 will be maintained relative to surface 24. It will further be understood by those skilled in the art that wheel means 26 may be positioned relative to scoop portion 12 and handle portion 14 such that the apparatus 10 may be balanced about the point of contact 27 of the perimeter of wheel means 26 with surface 24. If the center of gravity of apparatus 10 is located to the left (as seen in FIG. 1) of the point of contact 27, then apparatus 10 will be maintained at angle 22 with no effort by a user. That is, apparatus 10 will be maintained at angle 22 by virtue of the contact of leading edge 18 with surface 24 and the perimeter of wheel means 26 with surface 24.

As will be seen in FIG. 1, axle 32 is in one mode of operation oriented parallel to surface 24 and normal to a predetermined direction 34. It will be understood that direction 34 is the diagramatic representation of the predetermined direction in which a user may move apparatus 10 for the purpose of taking up and removing matter, for example, snow. Axle 32 may be skewed relative to leading edge 18 in another mode of operation of apparatus 10 by means to be described below. In either mode, wheel means 26 roll along surface 24 to facilitate the movement of apparatus 10 in direction 34. Accordingly, axle 32 is, in both modes, normal to direction 34.

As seen in FIGS. 1 and 2, axle 32 is secured at a predetermined position to apparatus 10, for example, to the back 36 of scoop portion 12 via shaft or other means 38. One end of shaft 38 is secured to the back 36 of scoop portion 12 while the other end is attached to axle 32 at a point intermediate the ends of axle 32. Axle 32 is mounted on shaft 38 so as to be rotatable about axis 40 thereof. While in one mode of operation, leading edge 18 may be parallel to axle 32 and normal to predetermined direction 34, upon rotation of axle 32 about axis 40 apparatus 10 will be oriented such that leading edge will be skewed relative to direction 34 (and also relative to axle 32) in any one of a plurality of predetermined positions. This orientation may be maintained by friction or detent means between shaft 38 and axle 32. Such skewing will cause any matter against which apparatus 10 (and leading edge 18) is urged to be urged to one side of a path extending along direction 34.

The rotation of axle 32 may be facilitated by use of a lever 42 pivotably mounted about point or shaft 44 secured to the handle portion 14. Secured to lever 42 and also pivotably mounted about shaft 44 is shaft or cross-member 46 having ends 48 and 50 equidistant from shaft 44. Pivotably secured to ends 48 and 50 are rods 52 and 54 respectively, the other ends of which, 56 and 58 respectively, are pivotably attached near the ends of axle 32 as shown in FIG. 2. It will be understood by those skilled in the art that the several pivotable rods and axles 46, 52, 54 and 32, must be engaged with their respective pivot points via bores 43 (or the like) having sufficient looseness of fit to enable the rods to pivot relative to each other. It will be further understood by those skilled in the art that the plane formed by cross-member 46 and rods 52 and 54 is generally perpendicular to the shaft 38, thereby facilitating rotation of axle 32 about axis 40.

Furthermore, it will be understood by those skilled in the art that the ends 56 and 58 of rods 52 and 54 may, in an alternative embodiment (not shown), be pivotably attached to or near the top edge 15 of scoop portion 12 in order to accomplish skewing.

Figure 3:
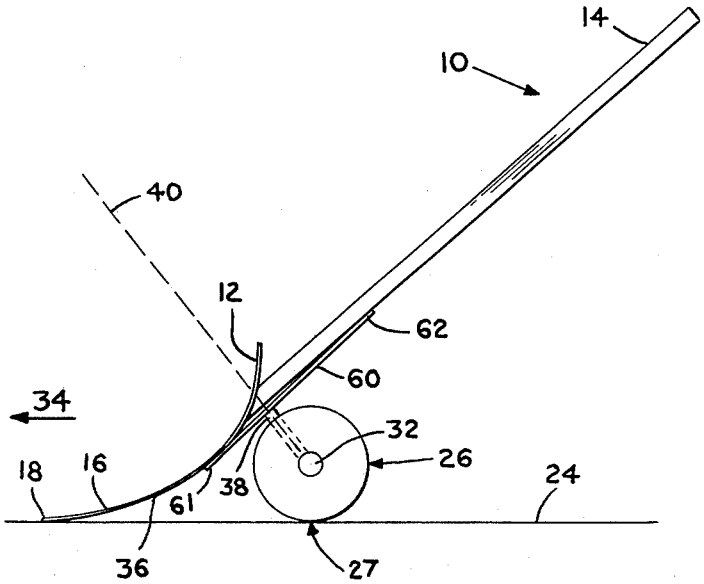
FIG. 3 is an alternate embodiment of apparatus shown in FIG. 1.

Referring now to FIG. 3, there is shown a side elevation view of an alternative embodiment of the invention. To facilitate understanding of FIG. 3, elements shown therein are numbered identically to those shown in FIGS. 1 and 2. Accordingly, it is noted that the embodiment depicted in FIG. 3 is not provided with means for skewing axle 32 relative to leading edge 18; axle 32 does not in this embodiment rotate relative to shaft 38 or axis 40. An additional difference in the embodiment of FIG. 3 from those described earlier is that wheel means 26 is not secured via shaft 38 directly to the back of scoop portion 12. Rather, shaft 38 is secured to an intermediate shaft or plate 60 which extends between scoop portion 12 and handle portion 14 and its ends 61 and 62 are welded or otherwise secured to each respectively. This structure facilitates the mounting of wheel means 26 at a point further to the right (as seen in FIG. 3) of the center of gravity of the apparatus. That is, in the embodiment shown in FIG. 3 the point of contact 27 of the wheel with surface 24 is further from leading edge 18 than it is in the embodiment shown in FIG. 1.

It will be understood by those skilled in the art that a plurality of scoop shapes may be suitable for use in the invention. The choice of scoop shape is substantially a matter of user preference and will not detrimentally affect an apparatus constructed in accordance with this invention.

It will be further understood by those skilled in the art that various modifications and improvements may be made upon the embodiments of the invention disclosed herein without departing from the spirit and scope thereof.

What is claimed is:

1. In an apparatus for taking up and removing matter from a surface upon movement of said apparatus in a predetermined direction along said surface, said apparatus having a scoop portion and a handle portion secured thereto, said scoop portion having a front surface for engagement with said matter upon said movement of said apparatus and a back surface, the improvement comprising:

an axle;

at least one wheel mounted rotatably on said axle and for rolling along said surface, said wheel having a predetermined diameter;

said axle secured to said apparatus at a predetermined point therealong and for being positioned parallel to said surface and normal to said predetermined direction; and upon said wheel rotating along said surface, said predetermined diameter of said wheel and said axle secured to said apparatus at said predetermined point maintaining said scoop portion at a predetermined angle with respect to said surface;

means for selectively skewing said scoop portion about a normal to said surface whereby said scoop portion may be selectively skewed to one of a plurality of predetermined positions relative to said predetermined direction, said skewing means further comprising:

a first rod and a second rod substantially equal in length to said first rod;

said first rod pivotally secured at one end thereof adjacent to one end of said axle and substantially perpendicular thereto;

said second rod pivotally secured at one end thereof adjacent the other end of said axle and substantially perpendicular thereto;

the other end of said first rod pivotally secured to one end of a longitudinally extending cross-member;

the other end of said second rod pivotally secured to the other end of said cross-member;

said cross-member pivotally mounted on said handle for pivotal movement about a second predetermined point;

lever means secured to said cross-member for pivoting said cross-member about said second predetermined point upon application of force;

whereupon, pivoting of said cross-member about said second predetermined point will cause said first and second rods to rotate said axle about said predetermined point.

2. In a snow shovel for plowing snow or the like from a surface upon movement of said snow shovel in a predetermined direction, the improvement comprising:

an axle;

at least one wheel mounted rotatably on said axle and for rolling along said surface, said wheel having a predetermined diameter;

said axle secured to said apparatus at a predetermined point therealong and for being positioned parallel to said surface and normal to said predetermined direction, and upon said wheel rotating along said surface, said predetermined diameter of said wheel and said axle secured to said apparatus at said predetermined point maintaining said scoop portion at a predetermined angle with respect to said surface;

means for selectively skewing said snow shovel about a normal to said surface whereby said snow shovel may be selectively skewed to one of a plurality of predetermined positions relative to said predetermined direction, said skewing means further comprising:

a first rod and a second rod substantially equal in length to said first rod;

said first rod pivotally secured at one end thereof adjacent one end of said axle and substantially perpendicular thereto;

said second rod pivotally secured at one end thereof adjacent the other end of said axle and substantially perpendicular thereto;

the other end of said first rod pivotally secured to one end of a longitudinally extending cross-member;

the other end of said second rod pivotally secured to the other end of said cross-member;

said cross-member pivotally mounted on said handle for pivotal movement about said second predetermined point;

lever means secured to said cross-member for pivoting said cross-member about said second predetermined point upon application of force;

whereupon, pivoting of said cross-member about said second predetermined point will cause said first and second rods to rotate said axle about said predetermined point.

* * * * *